US005490734A

United States Patent [19]

Maruyama et al.

[11] Patent Number: 5,490,734

[45] Date of Patent: Feb. 13, 1996

[54] METHOD OF CONTROLLING A CARRIAGE AND A PAPER FEED IN A PRINTER

[75] Inventors: Norihiro Maruyama; Takao Mimura, both of Nagano, Japan

[73] Assignee: Seiko Epson Corporation, Tokyo, Japan

[21] Appl. No.: 283,876

[22] Filed: Aug. 1, 1994

[30] Foreign Application Priority Data

Aug. 10, 1993 [JP] Japan ..... 5-218098

[51] Int. Cl.[6] ..... B41J 11/42

[52] U.S. Cl. ..... 400/582; 400/248; 400/279

[58] Field of Search ..... 400/708, 279, 400/74, 248, 582, 82

[56] References Cited

U.S. PATENT DOCUMENTS

| | | | |
|---|---|---|---|
| 4,948,279 | 8/1990 | Ikoma et al. | 400/279 |
| 4,960,337 | 10/1990 | Kato et al. | 400/248 |
| 5,007,751 | 4/1991 | Yamakawa | 400/279 |
| 5,087,134 | 2/1992 | Tanuma et al. | 400/74 |
| 5,286,123 | 2/1994 | Kusumi | 400/248 |
| 5,299,873 | 4/1994 | Miebori | 400/708 |

FOREIGN PATENT DOCUMENTS 2-155783 6/1990 Japan .

2-277683 11/1990 Japan .

*Primary Examiner*—Ren Yan
*Assistant Examiner*—John S. Hilten
*Attorney, Agent, or Firm*—Stroock & Stroock & Lavan

[57] ABSTRACT

The object of the current invention is to print characters, for example, on a substantially full area of a recording medium extended up to the leading or trailing edge of the recording medium. A carriage is moved so that a print hole of a ribbon mask is positioned at a medium center as viewed in the direction of feeding of a recording medium. The recording medium is fed to a position so that the print hole is at a print start position. A print operation is carried out toward a first side edge of the recording medium. The recording medium is then fed in the reverse direction to a position where the print hole is away from the recording medium as viewed in the character pitch direction. The carriage is then moved so that the print hole is positioned at a medium center as viewed in the direction of feeding of a recording medium. Thereafter, the medium is fed to a position so that the print hole is at a print start position. A print operation is then carried out toward a second side of the recording medium. A similar operation may be carried out to print on the trailing edge of a recording medium. Thus, characters may be printed on the leading or trailing edge of the recording medium without catching the any of the corners of the recording medium on the print hole.

20 Claims, 6 Drawing Sheets

METHOD OF CONTROLLING A CARRIAGE AND A PAPER FEED IN A PRINTER

BACKGROUND OF THE INVENTION

The present invention relates generally to a method of controlling a carriage and a paper feed in a printer. More particularly, the invention relates to a method of controlling a carriage and a paper feed in a printer, which enables characters to be printed on a substantially full area of a recording medium including the leading or trailing edge thereof without the print head catching on the leading or trailing edge or corners of the recording medium.

A printer generally includes a carriage, a print head mounted on the carriage, a ribbon mask mounted on the carriage, and an ink ribbon which is fed between a recording medium and a print hole formed in the ribbon mask on the front of the print head. Objects, or characters, are printed on the recording medium through the print hole. This type of printer, called a dot matrix printer, is well known in the prior art.

FIGS. 7(*a*) and 7(*b*) show a portion of a prior art dot matrix printer and the relationship of a print hole 1 of a ribbon mask and a recording medium 2 in a dot matrix printer. Reference numeral 3 designates wires driven forward out of the head.

In the prior art printer, when the carriage and a paper feed are controlled so that the printing operation starts from the leading end 2*b* of recording medium 2, a corner part 2*a* of recording medium 2 may catch in print hole 1 as it advances in the direction of Arrow A. As a result, the recording medium may be broken or the printer may work improperly.

Also in the printer of the type not having the ink ribbon and the ribbon mask, such as an ink jet printer, if corner part 2*a* of recording medium 2 is curled, the printing operation will progress so that the print head pushes up the curled corner 2*a* of recording medium 2, and the print head lies under curled corner 2*a* of recording medium 2.

To prevent print hole 1 from catching corner part 2*a* of recording medium 2, the conventional art controls the carriage and the paper feed so that the printing operation starts from a position where print hole 1 is located below leading edge 2*c* of recording medium 2, as shown in FIG. 8. As a result, the following problems are encountered.

As shown in FIG. 8, the upper end of print hole 1 and wire 3*a* located at the highest position are spaced a distance L from leading edge 2*c* of recording medium 2. As a result, it is impossible to print characters on the area of recording medium 2 within this distance L of leading edge 2*c* of recording medium 2. If it is attempted to print a character in this area within the distance L of the leading edge 2*c* of recording medium 2 using this prior art printer configuration and control, print hole 1 will catch corner part 2*a* of recording medium 2 as stated above.

The same problem of catching the corner of leading edge 2*c* of recording medium 2 also arises when trying to print on the trailing edge of recording medium 2.

SUMMARY OF THE INVENTION

Generally speaking, in accordance with the present invention, in a method of controlling a carriage and a paper feed in a printer, a carriage is moved relative to a recording medium so that the print hole of the ribbon mask is positioned at a print start position located between corners at opposed ends of an edge of the recording medium. The corners define the intersection of said edge and first and second opposed sides of the recording medium. At the print start position the print hole of the ribbon mask or the print head is not aligned with either of the corners. Characters are printed in the direction from the print start position toward one of said opposed corners of the recording medium. The path of initial movement of the carriage is spaced from said edge during at least the portion of the path in registration from with one of said opposed corners to prevent interference between the print hole of the ribbon mask and the one of the opposed corners.

During this printing operation, the print hole is moved from the print start position on the recording medium, which is sufficiently away from the corner part of the recording medium, toward the first side of the recording medium. Since the print head and print hole move from the middle of the recording medium to the outside thereof, the print hole will not catch the corner part of the recording medium during this first phase of printing.

After this first printing phase, the carriage is moved again relative to the recording medium so that the print hole bypasses the corner part of the recording medium, and returns to the print start position located between the corners of the recording medium, where the print hole or print head is not in alignment with either corner of the recording medium. Characters are then printed in the direction from the print start position toward the second side edge of the recording medium not printed in the first printing phase.

When the print hole is moved to the print start position, the print hole bypasses the corner part of the recording medium. Accordingly, the print hole will not catch the corner part of the recording medium during this movement. When the print operation is carried out in the second print phase, the print hole is moved from the print start position on the recording medium where it is between the corners of the recording medium, toward the side edge of the recording medium not printed during the first print phase. Thus, the print hole will not catch the corner part of the recording medium during this second print phase.

In one embodiment of the invention, the method of controlling a carriage and a paper feed in a printer is carried out so that the carriage moves and the print hole of the ribbon mask is positioned sufficiently away from the corner of the recording medium to the inside of the edge as viewed in the character pitch direction, and then the recording medium is fed in the forward direction. Thus, the control method of this embodiment is well adapted for use in a printer of the type in which the carriage is moved in the character pitch direction and the recording medium is moved in the direction orthogonal to the character pitch direction.

In another embodiment of the present invention, the method of controlling a carriage and a paper feed in a printer is carried out so the carriage moves and the print hole of the ribbon mask is positioned sufficiently away from the recording medium as viewed in the character pitch direction. The recording medium is first fed in the reverse direction so that the print hole of the ribbon mask is positioned sufficiently away from the recording medium as viewed in the direction of feeding the recording medium. The carriage is again moved so that the print hole of the ribbon mask is positioned between but sufficiently away from the opposed corners of the recording medium as viewed in the character pitch direction. Finally, the recording medium is fed in the forward direction. Accordingly, the control method of this embodiment is well adapted for use in a printer of the type in which the carriage is moved in the character pitch direction and the recording medium is moved in the direction orthogonal to the character pitch direction.

In yet another embodiment, a function similar to that set forth above for printing on the leading edge of the recording medium is used for printing on the trailing edge of the recording medium.

In still another embodiment, the method of controlling a carriage and a paper feed in a printer is carried out in a manner that the carriage is moved so that the print hole of the ribbon mask is positioned between and sufficiently away from the opposed corners of the recording medium as viewed in the character pitch direction, and then the recording medium is fed in the forward direction. Accordingly, the control method of this embodiment is well adaptable for the printer of the type in which the carriage is moved in the character pitch direction and the recording medium is moved in the direction orthogonal to the character pitch direction.

In still another embodiment, the method of controlling a carriage and a paper feed in a printer is carried out in a manner so that the carriage is moved so that the print hole of the ribbon mask is positioned at a position sufficiently away from the recording medium as viewed in the character pitch direction, the recording medium is then fed in the forward direction so that the print hole of the ribbon mask is positioned sufficiently away from the recording medium as viewed in the direction of feeding the recording medium, the carriage is again moved so that the print hole of the ribbon mask is positioned at a position between and sufficiently apart from the corner of the recording medium as viewed in the character pitch direction, and finally the recording medium is fed in the reverse direction. Accordingly, the control method as set forth in this embodiment is well adaptable for the printer of the type in which the carriage is moved in the character pitch direction and the recording medium is moved in the direction orthogonal to the character pitch direction.

It is a primary object of the invention to provide a method of controlling a carriage and paper feed in a printer in which objects are printed on a substantially full area of a recording medium including the leading and/or trailing edges, without the corner part of the recording medium catching in any of the print holes.

Still other objects and advantages of the invention will in part be obvious and will in part be apparent from the specification and drawings.

The invention accordingly comprises the features of construction, combinations of elements and elements and arrangement of parts which will be exemplified in the constructions hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which:

FIG. 7(*b*) is also a diagram showing the relationship between a print head and the recording medium in the prior art.

DETAILED DESCRIPTION OF THE PREFERRED EMBODIMENT

The present invention will be described with reference to the accompanying drawings.

Figure 2A:
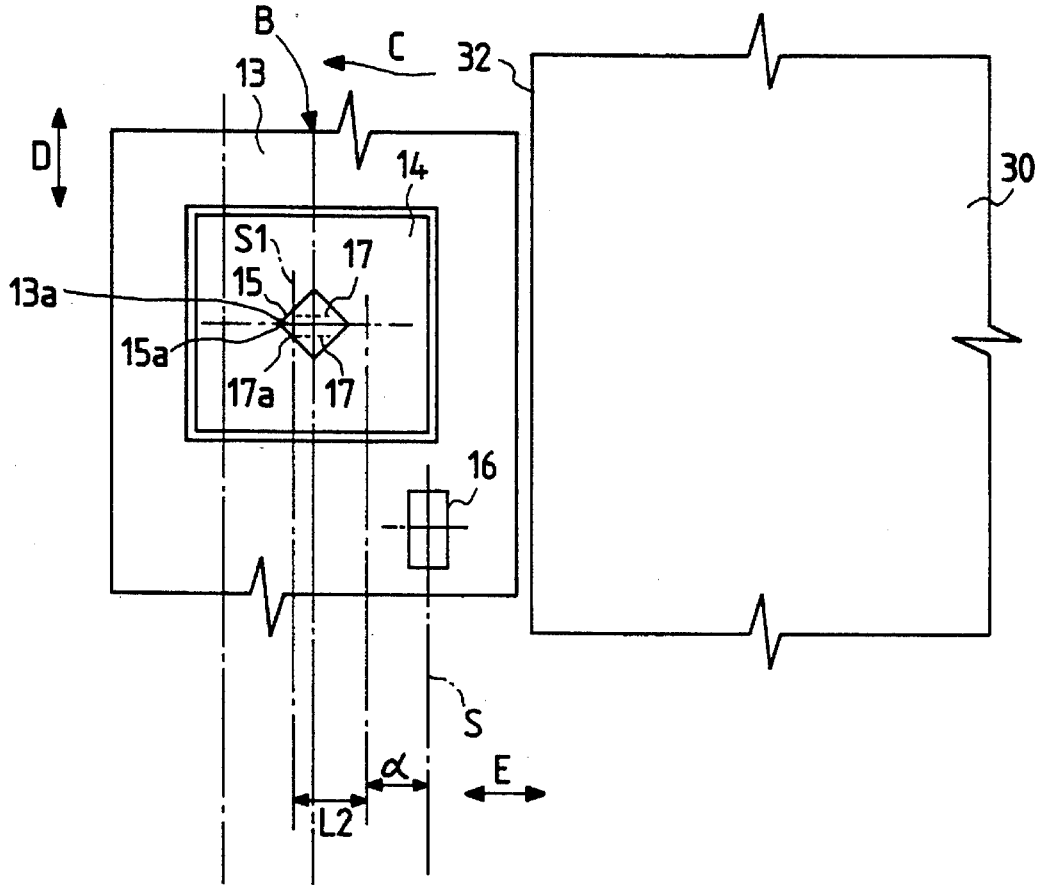
FIG. 2*a* is a fragmentary front plan view of a portion of a printer to which the control method is applied.
Figure 2B:
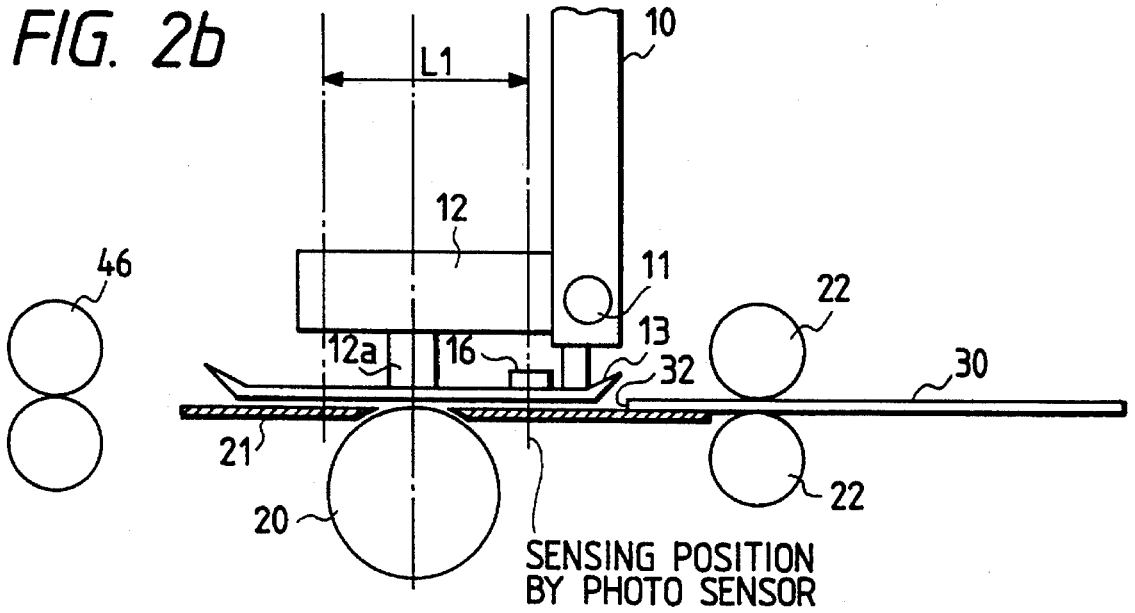
FIG. 2*b* is a side elevational view of the portion of the printer of FIG. 2*a;*

Reference is made to FIGS. 2*a* and 2*b* of the drawings which depict a portion of a printer of a first embodiment of a method of controlling a carriage and a paper feed in a printer according to the present invention. A carriage 10 is reciprocatively mounted along the axial line B and guided by a guide shaft 11 fastened to the frame (not shown). A print head 12 and a ribbon mask holder 13 made of transparent synthetic resin are fastened to carriage 10. A ribbon mask 14 formed of a thin metal plate is attached to the region of a central opening 13*a* in ribbon mask holder 13 so that ribbon mask 14 is located between print head 12 and a platen 20. Ribbon mask 14 includes a print hole 15 formed therein.

A photosensor 16 is mounted on ribbon mask holder 13. The photosensor detects a leading edge 32, a trailing edge 34 and both side edges 33 of a recording medium 30 as will be described later.

In the printer thus constructed, recording medium 30 is fed by a pair of feed rollers 22 into a space between ribbon mask 14 and platen 20, while being guided by a paper guide plate 21. An ink ribbon (not shown) is disposed in the space between the front end face (facing platen 20) of the nose 12*a* of print head 12 and ribbon mask 14. Wires 17 are driven forward out of the front end face of the nose of print head 12, thereby printing characters on recording medium 30, while carriage 10 is moving.

Figure 1:
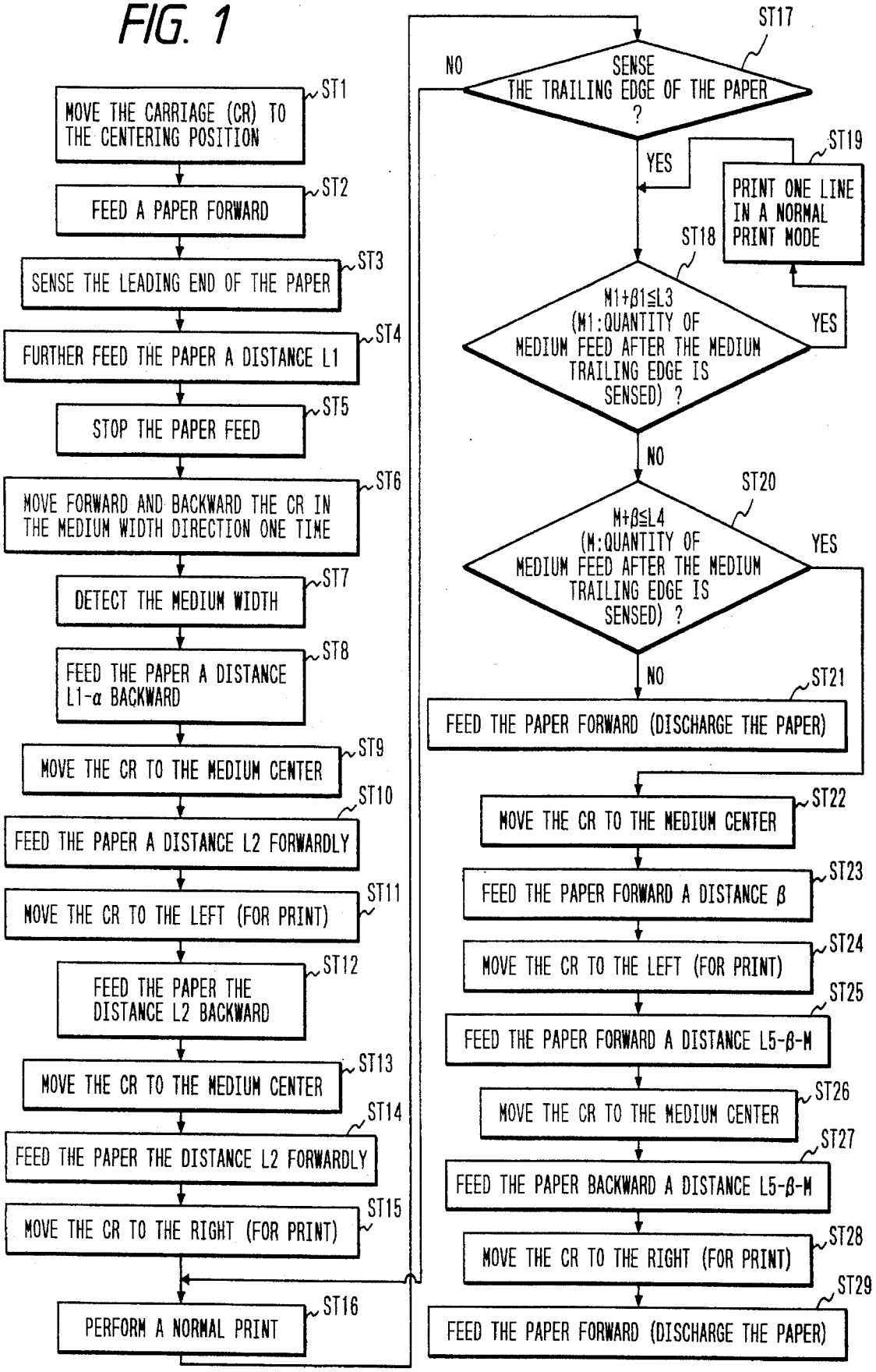
FIG. 1 is a flow chart showing a first embodiment of a method of controlling a carriage and a paper feed in a printer according to the present invention.
Figure 3:
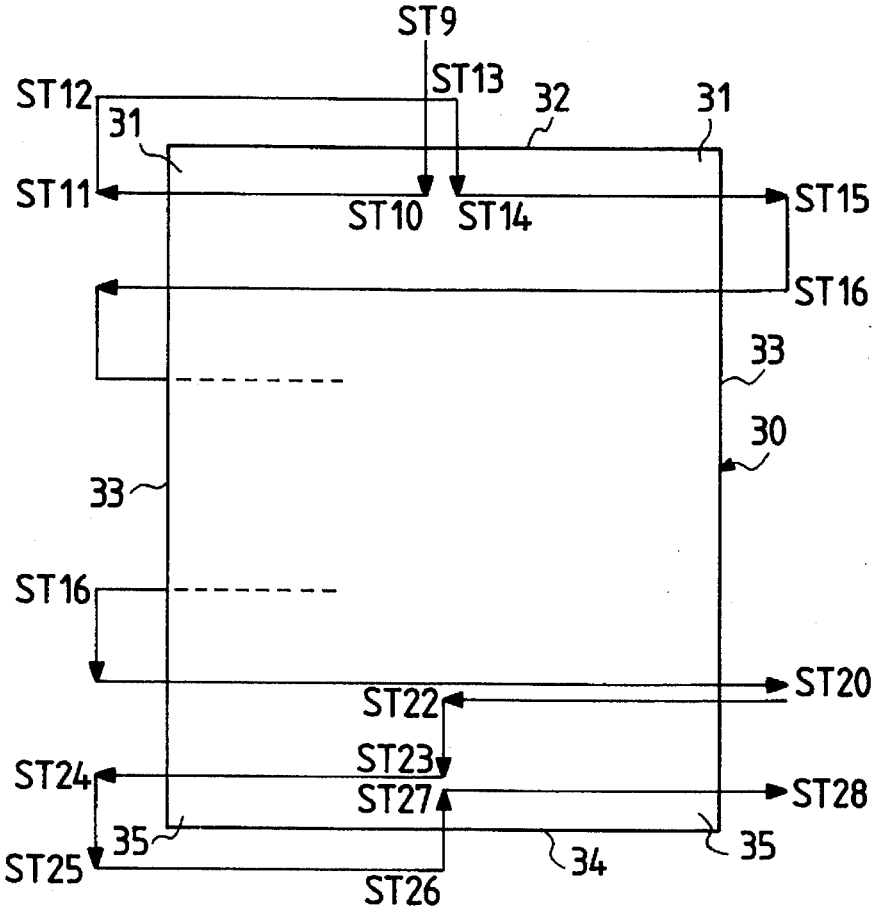
FIG. 3 is a diagram showing the operation of the printer during each step of operation.

Reference is now made to FIG. 1 of the drawings which is a flow chart showing a first embodiment of a method of controlling a carriage and a paper feed in a printer according to the present invention. Reference is made additionally to FIGS. 2 and 3 when explaining the steps in the flow chart of FIG. 1. FIG. 3 is a diagram in which the major motions of carriage 10 relative to recording medium 30 are indicated by arrows. In FIG. 3, the positions of carriage 10 and of the front end face of print head nose 12*a,* subsequent to a step ST9 in the flow diagram, are indicated by the step numbers (i.e. ST11 for step 11).

In step ST1 of FIG. 1, carriage 10 (CR in the flow diagram of FIG. 1) is moved from a stand-by position to a centering position. This centering position may be any position between side edges 33 of recording medium 30 so long as print hole 15 is a sufficient distance away from corner 31 of recording medium 30 and photosensor 16 is positioned between side edges 33 of recording medium 30 (FIG. 3).

In step ST2, paired feed rollers 22 are turned in the forward direction to feed recording medium 30 forward.

When recording medium 30 is fed forward, leading edge 32 of recording medium 30 is sensed by photosensor 16 at a sensing position S in step ST3. After being sensed by photosensor 16, recording medium 30 is further fed a distance L1 (FIGS. 2*a* and 2*b*, ST4) from sensing position S (FIGS. 2*a* and 2*b*) in the direction of Arrow C (FIG. 2*a*), and then the paper feed is stopped (step ST5).

Distance L1 is a distance recording medium 30 will be fed when leading edge 32 thereof has run past print hole 15, and has been sensed by photosensor 16 at sensing position S.

In step ST6, carriage 10 is moved reciprocately in the character pitch direction in order to detect the width of recording medium 30 (step ST7). More specifically, the width of recording medium 30 is determined by photosensor 16 detecting both side edges 33 of recording medium 30 through the movement of carriage 10 in the character pitch direction (Arrow D—FIG. 2*a*).

Print hole 15 will not catch corner 31 of recording medium 30 since leading edge 32 of recording medium 30 has passed print hole 15 in ST8.

In step ST8 paired feed rollers 22 are moved in a reverse direction a distance L1−α (FIG. 2*a*). As a result, leading edge 32 of recording medium 30 is moved into a position a distance α from sensing position S.

Distance α is set to a predetermined distance properly selected to be within a range in which leading edge 32 of recording medium 30 moved in the reverse direction is in a position away from print hole 15 (to the right as viewed in FIG. 2*a*), but not beyond sensor 16 (sensing position S).

Figure 4:
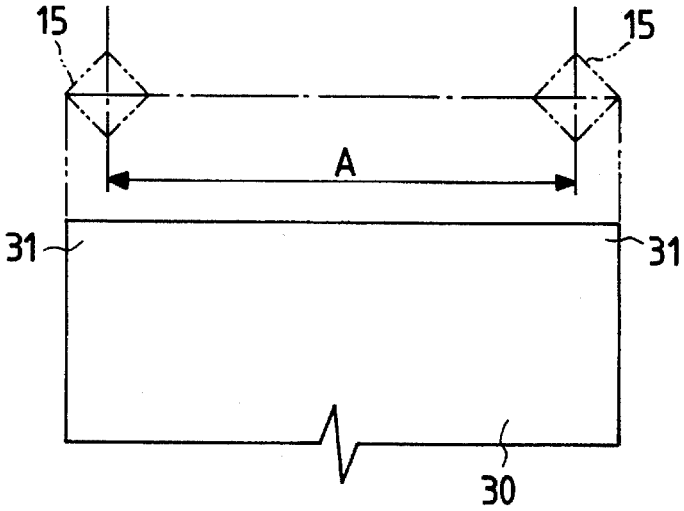
FIG. 4 is a diagram showing the operation of the printer during a particular step of operation.

In step ST9, carriage 10 is moved to the medium center (numeral ST9 in FIG. 3). Medium center is defined as a position where print hole 15 is spaced sufficiently from corners 31 of recording medium 30 to the inside thereof as viewed in the character pitch direction. The medium center may be selected at any position within the range denoted as A in FIG. 4.

In step ST10, paired feed rollers 22 are moved in the forward direction (Arrow C of FIG. 2*a*) to feed recording medium 30 a distance L2 (see FIG. 2*a* and ST 10 in FIG. 3). Leading edge 32 of recording medium 30 is put in a position S1 located a distance α+L2 apart from sensing position S. Print hole 15 of ribbon mask 14 is located at a print start position ST10 (FIG. 3) on recording medium 30, which is located away from corner 31 of recording medium 30.

The distance L2 may be set within the range in which the position S1 of leading edge 32 of recording medium 30 lies to the left of a leftmost wire 17*a* of wires 17 of print head 12 as viewed in FIG. 2*a*, and to the right of a front end 15*a* (leftmost end as viewed in FIG. 2*a*) of print hole 15 (FIG. 2*a*).

In step ST11, carriage 10 is moved to the left as viewed in FIG. 3, and a printing operation is performed (See ST11 in FIG. 3). In this particular embodiment, the left portion as viewed in FIG. 3 of recording medium 30 with respect to the print start position on leading edge 32 of recording medium 30 undergoes the print operation in this first print phase.

In step ST12, paired feed rollers 22 are turned in the reverse direction and move recording medium 30 a distance L2 in the reverse direction (ST12 in FIG. 3). Leading edge 32 of print medium 30 is returned to the position located a distance α away from sensing position S.

In step ST13, carriage 10 is moved to the medium center (ST13 in FIG. 13).

In step ST14, paired feed rollers 22 are turned in the forward direction (Arrow C in FIG. 2*a*) and feed recording medium 30 a distance L2 (ST14 in FIG. 13). Print hole 15 of ribbon mask 14 is positioned at the print start position (indicated by ST14 in FIG. 3), which is essentially the same position as the print start position in step ST10, which is away from corner 31 of recording medium 30.

In steps ST12 to ST14, print hole 15 bypasses one corner 31 of recording medium 30 and is moved to the print start position away from corner 31 of recording medium 30.

In step ST15, carriage 10 is moved to the right as viewed in FIG. 3, and a printing operation is performed (ST15 in FIG. 3). In this particular embodiment, the right half of leading edge 32 of recording medium 30 not printed during the first print phase undergoes the print operation in this second print phase.

In step ST16, characters are printed in a normal print mode on the majority of recording medium 30. Carriage 10 is simply reciprocatively moved while the medium is fed at the line feed pitches, and print operations are performed while the carriage moves.

In step ST17, the system control checks whether trailing edge 34 of recording medium 30 (FIG. 3) is sensed by photosensor 16. If photosensor 16 has not yet sensed trailing edge 34 of recording medium 30, the system control returns to step ST16. Accordingly, recording medium 30 undergoes the normal print procedure of step ST16 until step ST17 senses trailing edge 34 of recording medium 30.

Figure 5:
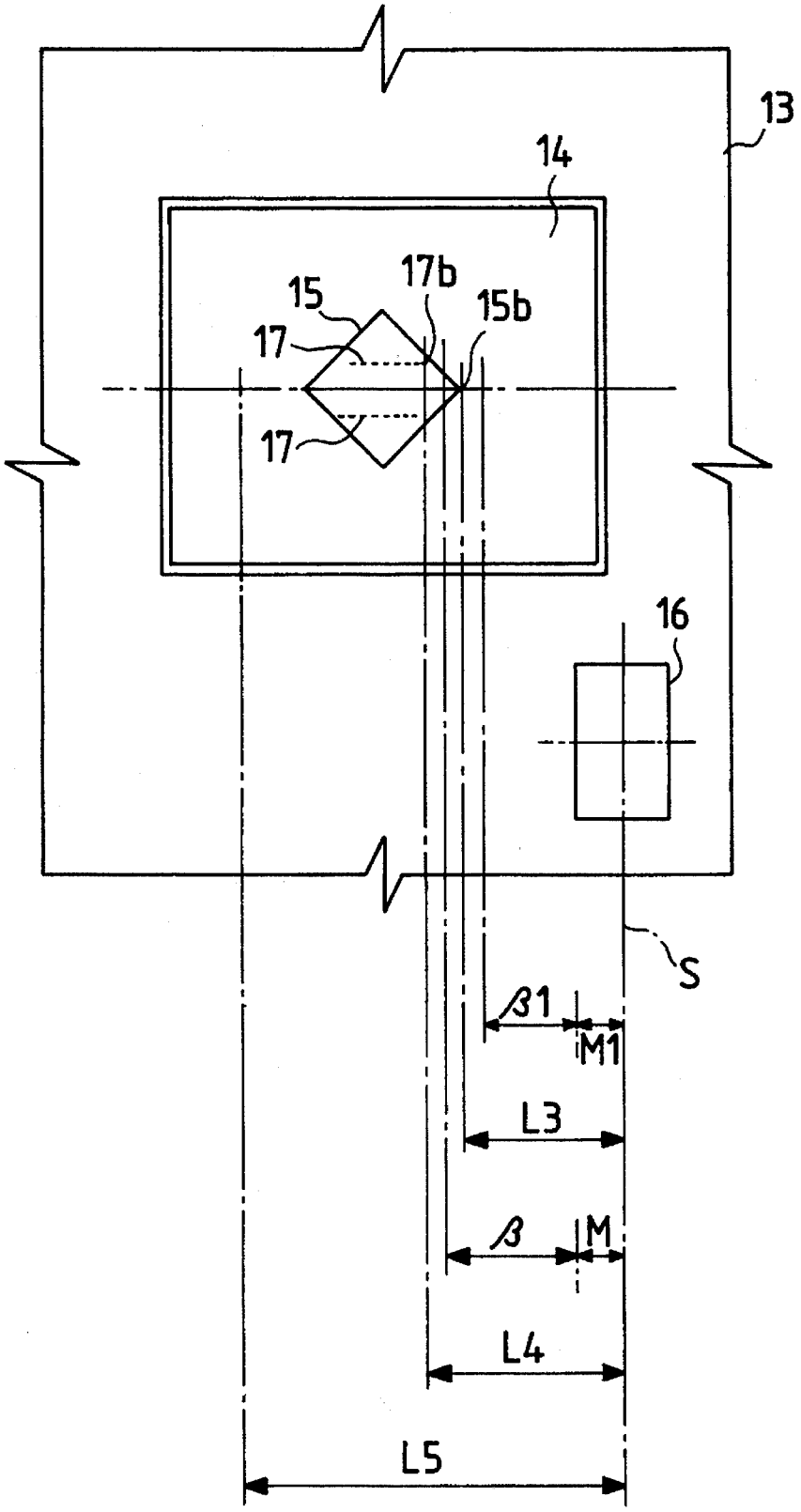
FIG. 5 is a diagram showing the operation of the printer during a number of particular steps of operation.

When trailing edge 34 of recording medium 30 is sensed in step ST17 by photosensor 16, step ST18 is performed in which the control system checks whether M1+β1 is equal to or less than L3 (M1+β1≦L3) (FIG. 5). M1 indicates a quantity of recording medium 30 fed after photosensor 16 senses trailing edge 34 of recording medium 30. This recording medium 30 feed quantity can be known by counting the number of advances of the paper feed motor after photosensor 16 senses trailing edge 34 of recording medium 30.

β1 indicates a quantity of line feed (line feed pitch) required for a normal print step (step ST16) to take place without interference between print hole 13 and corners 35.

L3 indicates the distance ranging from sensing position S defined by photosensor 16 to the back end 15*b* (rightmost end as viewed in FIG. 5) of print hole 15. If recording medium 30 moves in excess of distance L3, trailing edge 34 of recording medium 30 will enter the area of print hole 15.

During step ST18, if M1+β1 is equal to or less than L3 (M1+β1≦L3), the control system recognizes that a space large enough to print one more lines in normal print mode is still left on recording medium 30. Accordingly, in step ST19, the control system directs the printer to print one line and returns to the step ST18.

Figure 7A:
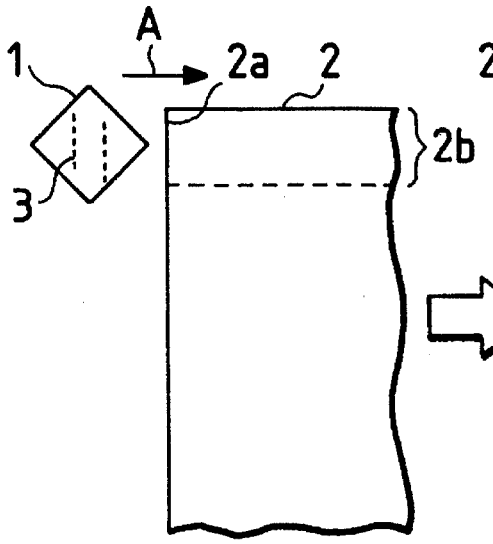
FIG. 7(a) PRIOR ART
FIG. 7(*a*) is a diagram showing the relationship between a print head and the recording medium in the prior art.
Figure 7B:
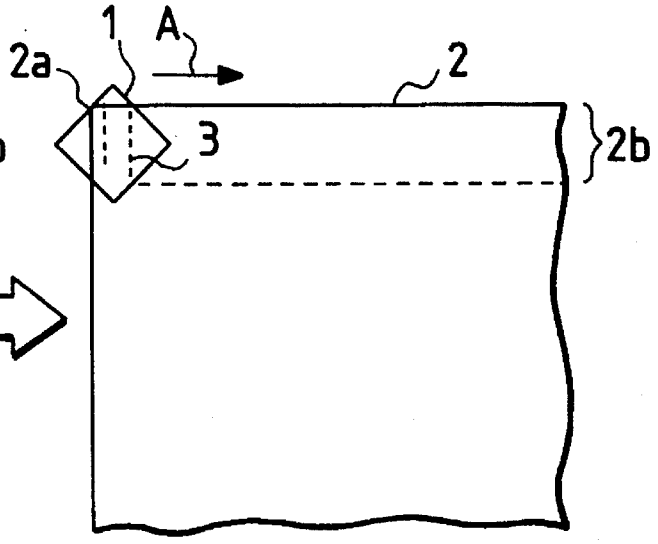
FIG. 7(b) PRIOR ART
Figure 8:
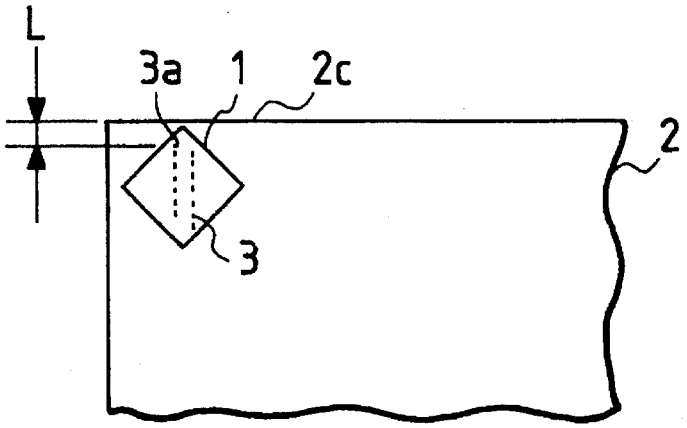
FIG. 8 PRIOR ART
FIG. 8 is an additional diagram showing the relationship between a print head and the recording medium in the prior art.

If M1+β1 is more than L3, the system control recognizes that if the normal print is performed, trailing edge 34 of recording medium 30 will enter the area of print hole 15. If this were permitted, when print hole 15 moves to print from outside edge 33 of recording medium 30, it may catch a corner 35 of recording medium 30 (FIG. 7, FIG. 3). Step ST18 is provided to prevent such an unwanted situation.

In step ST18, if the control system determines that M1+β1 is neither equal to nor less than L3 (M1+β1≦L3), the control system recognizes that characters cannot be printed on trailing edge 34 of recording medium 30 in the normal print mode through simple reciprocative motion of carriage 10. Thus, the system control advances to step ST20.

In step ST20, the system control checks as to whether M+β is equal to or less than L4 (M+β≦L4) (FIG. 5). M indicates a quantity of recording medium 30 fed after photo sensor 16 senses trailing edge 34 of recording medium 30. This recording medium 30 feed quantity can be known by counting the number of advances of the paper feed motor after photo sensor 16 senses trailing edge 34 of recording medium 30. Accordingly, when the system control advances from step ST18 to step ST20 and bypasses step ST 19, M=M1 (FIG. 5). However, when the control system once passes through step ST19 before moving from step ST18 to step ST20, M=M1+β1.

β indicates a quantity of line feed between the present print line and the next one. β may be equal to β1 or not equal to β1.

L4 indicates a distance between sensing position S and a rightmost wire 17*b* of wires 17 as viewed in FIG. 5. If M+β>L4, rightmost wire 17*b* would travel off of trailing edge 34 of recording medium 30.

If step ST20 determines that M+β is neither equal to nor less than L4 (M+β≦L4), the control system recognizes that no further printable area is left on the trailing end area of recording medium 30, and wires 17 have at least in part traveled off trailing edge 34 of recording medium 30. Therefore, recording medium 30 is discharged in step ST21.

If step ST20 determines that M+β is equal to or less than L4 (M+β≦L4), the control system recognizes that a printable area is still left on trailing edge 34 of recording medium 30, and wires 17 have not traveled off trailing edge 34 of recording medium 30. The printer enters step ST22 in which a phase of a printing operation is entered in which printing on trailing edge 34 of recording medium 30 is performed.

In step ST22, carriage 10 is moved to the medium center (ST22 in FIG. 3).

In step ST23, paired eject rollers 46 are turned in the forward direction, to feed recording medium 30 a distance β (FIG. 5 and ST23 in FIG. 3). As a result, trailing edge 34 of recording medium 30 is put in a position which is a distance M+β away from sensing position S. Print hole 15 of ribbon mask 14 is positioned at the print start position (indicated by ST23 in FIG. 3) on recording medium 30, which is between corners 35 of trailing edge 34 of recording medium 30.

In step ST24, carriage 10 is moved to the left as viewed in FIG. 3, and a print operation is performed (ST24 in FIG. 3). In this particular embodiment, the left portion of recording medium 30 with respect to the print start position on trailing edge 34 of recording medium 30 undergoes the print operation during this first print phase.

In step ST25, paired eject rollers 46 are turned in the forward direction to feed recording medium 30 a distance L5–β–M (ST25 in FIG. 3). As a result, trailing edge 34 of recording medium 30 is put in a position located a distance L5 beyond sensing position S of photo sensor 16.

L5 is the distance recording medium 30 is fed after trailing edge 34 of recording medium 30 has moved past print hole 15 and step ST25 is invoked.

In step ST26, carriage 10 is moved to the medium center of recording medium 30 (ST26 in FIG. 3).

In step ST27, paired eject rollers are turned in the reverse direction to feed recording medium 30 a distance L5–β–M (ST27 in FIG. 3). As a result, trailing edge 34 of recording medium 30 is returned to a position a distance M+ β beyond sensing position S of photo sensor 16. Print hole 15 of ribbon mask 14 is positioned at the print start position (ST27 in FIG. 3) on recording medium 30 between corners 35 of trailing edge 34 of recording medium 30.

In steps ST25 to ST27, print hole 15 bypasses one corner 35 of recording medium 30, and is moved to the print start position away from corner 35 on trailing edge 34 of recording medium 30.

In step ST28, carriage 10 is moved to the right in FIG. 3, thereby performing a printing operation (ST28 in FIG. 3). In this particular embodiment, the remaining right half of trailing edge 34 of recording medium 30 not printed during the first print phase undergoes the print operation in this second print phase. In step ST29 recording medium 30 is discharged.

In the method of controlling a carriage and a paper feed in a printer, which is thus far described, when characters are printed on leading edge 32 or trailing edge 34 of recording medium 30, print hole 15 moves from the print start position on the medium, which is away from corners 31 or 35 of recording medium 30, toward side edges 33 of recording medium 30. Thus, print hole 15 will never catch a corner 31 or 35 of recording medium 30. Characters may be printed on a substantially full area of recording medium 30 extending up to leading edge 32 or trailing edge 34 thereof.

Figure 6:
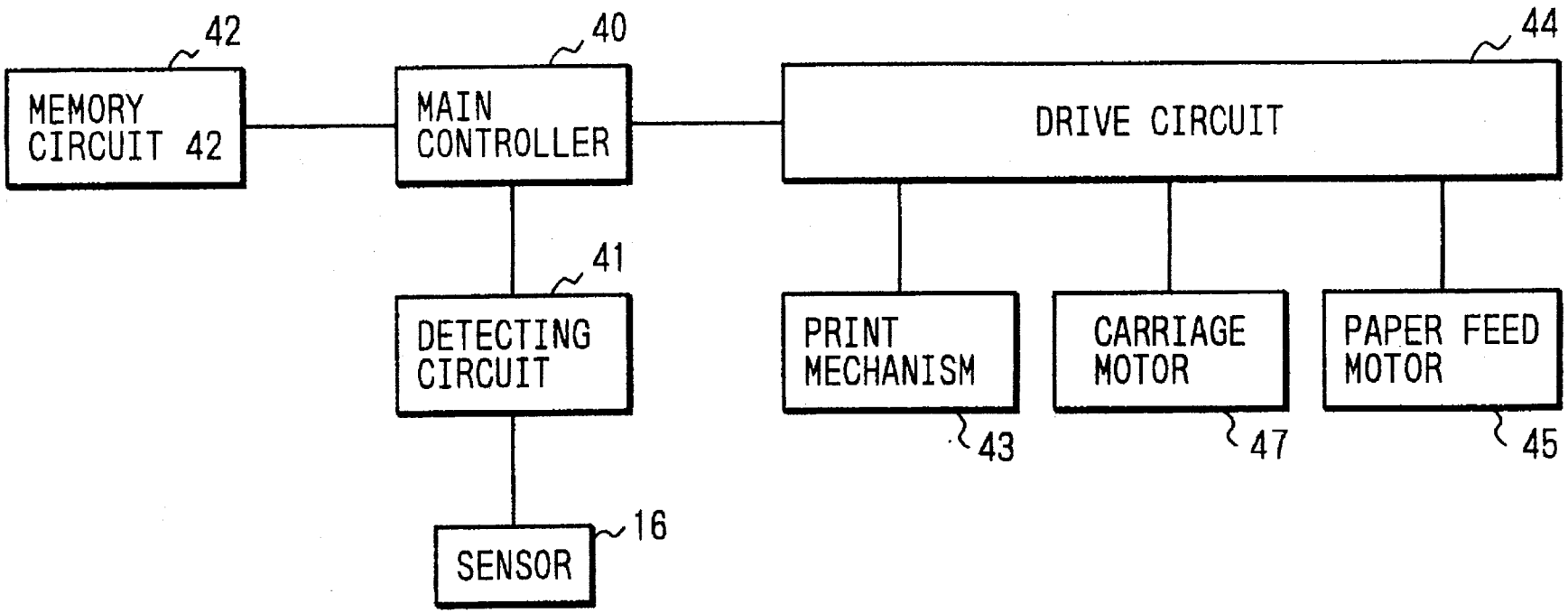
FIG. 6 is a block diagram showing the printer incorporating the control method of the present invention.

Reference is now made to FIG. 6 which shows a block diagram of the printer portions necessary to carry out the process of the above-mentioned embodiment. In the Figure, reference numeral 16 designates the above-mentioned photo sensor. A detecting circuit 41 detects the width of recording medium 30 and leading edge 32 and trailing edge 34 thereof using sensing signals.derived from photo sensor 16. The sensing signals are stored through a main controller 40 into a memory circuit 42.

Reference numeral 45 designates a paper feed motor for driving paired feed rollers 22. Reference numeral 42 is a carriage motor for moving carriage 10. Reference numeral 43 is a print mechanism for driving print head 12 and the ink ribbon feed mechanism. Reference numeral 44 is a drive circuit for driving paper feed motor 45, carriage motor 42, and print mechanism 43.

In a second embodiment of the present invention, the following modifications may be made. In the above-mentioned first embodiment, the print start position in step ST10 is the same as that in step ST14 as viewed in the character pitch direction. However, in the second embodiment, these print start positions may be different from each other so long as a reliable print on leading edge 32 of recording medium 30 is insured. The same thing is true for the print start positions on trailing edge 34 of recording medium 30 in the steps ST23 and ST27.

In a third embodiment of the present invention, the following modifications may be made. In the first embodiment mentioned above, when print hole 15 is moved to the print start position on leading edge 32 of recording medium 30, start position on trailing edge 34 of recording medium 30, carriage 10 is moved to a position, which is sufficiently away from corners 31 or 35 of recording medium 30, and between the corners as viewed in the character pitch direction, and then recording medium 30 is fed either in the forward direction or in the reverse direction. However, in the third embodiment, in a printer of the type in which the carriage is movable in the direction orthogonal to the character pitch direction, the carriage may be moved also in the direction orthogonal to the character pitch direction instead of feeding the recording medium. In such an arrangement, guide shaft 11, platen 20 and paper guide plate 21 would be mounted on a carriage (not shown) for movement in the direction of arrow E of FIG. 2*a*.

In a fourth embodiment of the present invention, the following modifications may be made. In the above-mentioned first embodiment, when printing characters on leading edge 32 of recording medium 30, carriage 10 is first moved to the left as viewed in FIG. 3, and then is moved to the right. However, in the fourth embodiment, if required, carriage 10 may first be moved to the right, and then to the left. The same thing is true when printing on trailing edge 34 of recording medium 30. In a fifth embodiment of the present invention, the following modifications may be made. The above-mentioned first embodiment is designed so as to print characters of one line on leading edge 32 or trailing edge 34 of recording medium 30. However, in the fifth embodiment, the carriage/paper feed controlling method of the invention is likewise applicable for the printing of characters of two more lines in the same recording medium area. The reason for this is that when the print hole size, the wire layout area, and the line feed pitch are selected so as to have specific values, a print area of two or more lines is often used in an area where the print head is near to leading edge 32 or trailing edge 34 of recording medium 30.

As described above, according to the invention, when characters of the dot matrix printer are printed on a leading or trailing edge over a recording medium, the printer moves from the print start position on the recording medium, which is away from, and between the corners of the recording medium, towards a side edge of the medium. Thus, the printer will not catch either corner of the recording medium.

It will thus be seen that the objects set forth above, among those made apparent from the preceding description, are efficiently attained and, since certain changes may be made in the above method without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed:

1. A method of controlling a print head and a recording medium feed in a printer, the recording medium having a leading edge between first and second corners and first and second sides, comprising the steps of:

moving a print head and a recording medium relatively so that the print head is positioned at a print start position located substantially midway between said first and second corners;

carrying out a print operation from the print start position toward the first side of the recording medium;

moving the print head and the recording medium relatively so that the print head bypasses the corner of the recording medium, and is returned to the print start position; and carrying out a print operation from the print start position toward the second side edge of the recording medium.

2. The method of claim 1, wherein the print start position is located so that there is no interference between the print head and said corners.

3. A method of controlling a print head and a recording medium feed in a printer, the recording medium having a trailing edge between first and second corners and first and second sides, comprising the steps of:

moving a print head and a recording medium relatively so that the print head is positioned at a print start position, the print start position being located away from the first or second corners of the recording medium;

carrying out a print operation from the print start position toward the first side edge of the recording medium;

moving the print head and the recording medium relatively so that the print head bypasses the corner of the recording medium, and is returned to the print start position; and carrying out a print operation from the print start position toward the second side edge of the recording medium.

4. The method of claim 3, wherein the print start position is located so that there is no interference between the print head and said corners.

5. A method of controlling a carriage and a recording medium feed in a printer having a carriage, a print head mounted on the carriage, a ribbon mask mounted on the carriage in a state that the ribbon mask is located between an ink ribbon supplied to the front end of the print head and a recording medium, and a print hole formed in the ribbon mask, the recording medium having a leading edge between first and second corners and first and second sides, comprising the steps of, moving a carriage and a recording medium relatively so that a print hole of a ribbon mask is positioned at a print start position, the print start position being located away from the first or second corners of the recording medium;

carrying out a print operation from the print start position toward the first side of the recording medium;

moving the carriage and the recording medium relatively so that the print hole bypasses the corner of the recording medium, and is returned to the print start position; and carrying out a print operation from the print start position toward the second side of the recording medium.

6. The method of claim 5, wherein the print start position is located so that there is no interference between the print head and said corners.

7. The method according to claim 5, in which returning the carriage to the print start position is carried out so that the carriage is moved to position the print hole of the ribbon mask sufficiently away from the recording medium as viewed in the character pitch direction, the recording medium is then fed in the reverse direction so that the print hole of the ribbon mask is positioned sufficiently away from the recording medium as viewed in the direction of feeding the recording medium, the carriage is then moved so that the print hole of the ribbon mask is positioned sufficiently away from one of the corners of the recording medium between the corners as viewed in the character pitch direction, and finally the recording medium is fed in the forward direction.

8. The method according to claim 7, wherein the print hole of the ribbon mask is positioned sufficiently away from the corners when positioned between them to prevent interference between the print hole and a corner.

9. The method according to claim 7, in which moving the carriage to the print start position is carried out so that the carriage is moved to position where the print hole of the ribbon mask sufficiently away from the corner of the recording medium and between the corners as viewed in the character pitch direction, and then the recording medium is fed in the forward direction.

10. The method according to claim 9, wherein the print hole of the ribbon mask is positioned sufficiently away from the corners when positioned between them to prevent interference between the print hole and a corner.

11. The method according to claim 7, in which returning the carriage to the print start position is carried out so that the carriage is moved to position the print hole of the ribbon mask sufficiently away from the recording medium as viewed in the character pitch direction, the recording medium is then fed in the reverse direction so that the print hole of the ribbon mask is positioned sufficiently away from the recording medium as viewed in the direction of feeding the recording medium, the carriage is then moved so that the print hole of the ribbon mask is positioned sufficiently away from the corner of the recording medium where between the corners as viewed in the character pitch direction, and finally the recording medium is fed in the forward direction.

12. The method according to claim 11, wherein the print hole of the ribbon mask is positioned sufficiently away from the corners when positioned between them to prevent interference between the print hole and a corner.

13. A method of controlling a carriage and a recording medium feed in a printer having a carriage, a print head mounted on the carriage, a ribbon mask mounted on the carriage in a state that the ribbon mask is located between an ink ribbon supplied to the front end of the print head and a recording medium, and a print hole formed in the ribbon mask, the recording medium having a trailing edge between first and second corners and first and second sides, comprising the steps of:

moving a carriage and a recording medium relatively so that a print hole of a ribbon mask is positioned at a print start position, the print start position being located away from the first or second corners of the recording medium;

carrying out a print operation from the print start position toward the first side edge of the recording medium;

moving the carriage and the recording medium relatively so that the print hole bypasses the corner of the recording medium, and is returned to the print start position; and carrying out a print operation from the print start position toward the second side edge of the recording medium.

14. The method of claim 13, wherein the print start position is located so that there is no interference between the print head and said corners.

15. The method according to claim 13, in which returning the carriage to the print start position is carried out so that the carriage is moved to position the print hole of the ribbon mask sufficiently away from the recording medium as viewed in the character pitch direction, the recording medium is then fed in the forward direction so that the print hole of the ribbon mask is positioned sufficiently away from the recording medium as viewed in the direction of feeding the recording medium, the carriage is then moved so that the print hole of the ribbon mask is positioned sufficiently away from the corner of the recording medium between the corners as viewed in the character pitch direction, and finally the recording medium is fed in the reverse direction.

16. The method according to claim 15, wherein the print hole of the ribbon mask is positioned sufficiently away from the corners when positioned between them to prevent interference between the print hole and a corner.

17. The method according to claim 16, in which the movement of the carriage to the print start position is carried out so that the carriage is moved to position where the print hole of the ribbon mask sufficiently away from the corner of the recording medium and between the corners as viewed in the character pitch direction, and then the recording medium is fed in the reverse direction.

18. The method according to claim 15, wherein the print hole of the ribbon mask is positioned sufficiently away from the corners when positioned between them to prevent interference between its print hole and a corner.

19. The method according to claim 17, in which returning the carriage to the print start position is carried out so that the carriage is moved to position the print hole of the ribbon mask sufficiently away from the recording medium as viewed in the character pitch direction, the recording medium is then fed in the forward direction so that the print hole of the ribbon mask is positioned sufficiently away from the recording medium as viewed in the direction of feeding the recording medium, the carriage is then moved so that the print hole of the ribbon mask is positioned sufficiently away from the corner of the recording medium where between the corners as viewed in the character pitch direction, and finally the recording medium is fed in the reverse direction.

20. The method according to claim 19, wherein the print hole of the ribbon mask is positioned sufficiently away from the corners when positioned between them to prevent interference between the print hole and a corner.

* * * * *